United States Patent [19]

Pape et al.

[11] 3,990,223

[45] Nov. 9, 1976

[54] AUTOMATIC HANDLING OF YARN COPS

[75] Inventors: Klaus Pape, Bremen; Rudolf Teupel, Ritterhude; Friedrich Wachendorf, Schwanewede, all of Germany

[73] Assignee: Fried. Krupp Gesellschaft mit beschrankter Haftung, Essen, Germany

[22] Filed: May 14, 1975

[21] Appl. No.: 577,207

[30] Foreign Application Priority Data

May 25, 1974 Germany ..... 2425434

[52] U.S. Cl. ..... 57/54; 57/34 R; 57/108; 57/156

[51] Int. Cl.[2] ..... D01H 9/14; D01H 13/06

[58] Field of Search ..... 57/52–54, 57/34 R, 1 R, 106, 34 TT, 108, 110, 156

[56] References Cited

UNITED STATES PATENTS

| | | | |
|---|---|---|---|
| 2,690,643 | 10/1954 | Vella | 57/110 X |
| 2,747,360 | 5/1956 | Vella | 57/110 X |
| 2,770,093 | 11/1956 | Gwaltney | 57/110 X |
| 2,865,162 | 12/1958 | Hope | 57/110 |
| 2,892,301 | 6/1959 | Cone | 57/54 |
| 2,949,726 | 8/1960 | Latus | 57/54 X |
| 3,097,476 | 7/1963 | Fetterman, Jr. | 57/110 |

*Primary Examiner*—John Petrakes
*Attorney, Agent, or Firm*—Spencer & Kaye

[57] ABSTRACT

A method and apparatus for the simultaneous freeing of yarn at a group of cops during the changing of cops in a spinning machine having spindles without appendages, the machine including a yarn guide rail carrying yarn guides which grip the yarn from the side and means supporting the guide rail for downward movement from the region above the spindles toward the foot of the spindles, wherein the yarn guide rail is employed as the yarn freeing rail and downward movement of the yarn guide rail is effected by initially rotating the rail through 90° about an axis extending in the longitudinal direction of the rail so that the yarn guides are pivoted downwardly, and subsequently lowering the yarn guide rail toward the foot of the spindles.

7 Claims, 4 Drawing Figures

AUTOMATIC HANDLING OF YARN COPS

BACKGROUND OF THE INVENTION

The present invention relates to a method and apparatus for the simultaneous freeing of yarn in a group of cops during the changing of cops in circular spinning machines with spindles having no spindle appendages, in which a yarn freeing rail which grips the yarn from the side is lowered from the area above the spindles to the foot of the spindles.

The similtaneous freeing of yarn in a group of cops makes it possible to substantially reduce the servicing time during the changing of cops, and thus the unproductive time, particularly when an automatic cops changing device is used.

German Offenlegungsschrift (Laid-Open U.S. Pat. Application) No. 2,235,165 discloses spinning machines with spindles which are provided with spindle appendages in the form of spinning fingers and in this arrangement the yarn is deflected to the side of the cop, after it has been freed by the spinning finger, by being gripped by a special yarn catching bar in the area below the upwardly pivoted yarn guides, the bar then being lowered toward the foot of the spindle.

SUMMARY OF THE INVENTION

It is the object of the present invention to substantially simplify this known process for use in spinning machines having spindles without appendages. This and other objects according to the present invention are achieved by using the yarn guide rail as the yarn freeing rail, the yarn guides being initially pivoted downwardly by a 90° rotation of the yarn guide rail and then the yarn guide rail being lowered toward the foot of the spindle.

The method according to the present invention has the advantage that simultaneous freeing of the yarn at a group of cops is effected with the utmost dependability without requiring manual adjustments.

This is of particular importance when automatic cops changing devices are used. The value of using such devices, which are very expensive to manufacture, would be considerably reduced if once the devices pass through the system the yarn would have to be manually adjusted at a relatively large number of spinning positions.

This danger is substantially eliminated in that the yarn guide rail which serves as the yarn freeing rail safely grips the yarn via the yarn guides and thus lowering of the yarn guide rail will dependably effect the required deflection of the yarn toward the side and away from the cop.

A further advantage of the present invention is that the dependable freeing of the yarn simultaneously at a group of cops is effected relatively inexpensively since substantially only the already provided yarn guides are lowered. This eliminates an additional gripping device.

The longitudinal rotation of the yarn guide rail for the purpose of pivoting the yarn guides downwardly as well as lowering of the yarn guide rail toward the foot of the spindle can be effected manually. It is, however, just as easily possible to provide a motor drive for each of these two processes. These two motor drives can be switched on by switching pulses. In addition, it is possible to have the process according to the present invention take place completely automatically. This can be effected by associating with the two motor drives a servo control which can be actuated with but a single switching pulse.

The objects of the present invention are also achieved by apparatus in which, in an advantageous and inexpensive manner, the yarn guide rail, which is longitudinally rotatable in order to pivot out the yarn guides, is connected to the drive of the balloon control rail (BC rail) and, after initial combined lowering, the yarn guide rail continues moving downwardly by itself until it reaches the balloon control rail in its lowest position.

DESCRIPTION OF THE PREFERRED EMBODIMENTS

Figure 2:
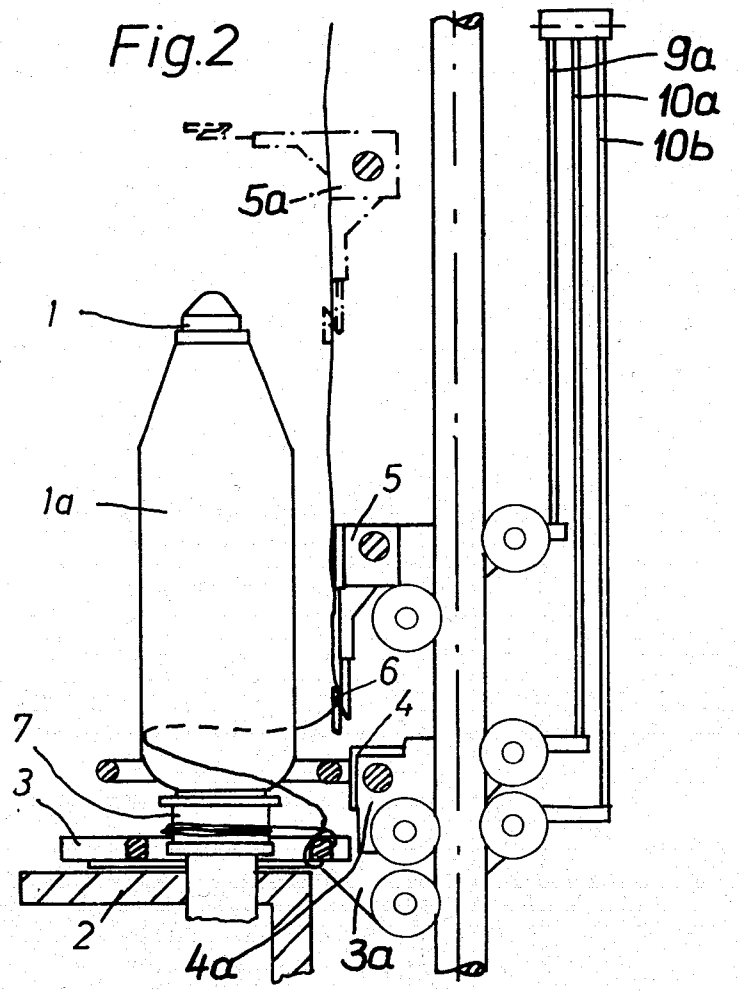
FIG. 2 is a view similar to that of FIG. 1 of the spindle of FIG. 1 with a full cop after the yarn has been released according to the present invention, the ring rail being still in the underwinding position, the balloon control rail having dropped to its lowest position, the yarn guide rail having the yarn guides pivoted away to their dash-dot positions and having been lowered down to the balloon control rail, the yarn being approximately in the position as shown.
Figure 1:
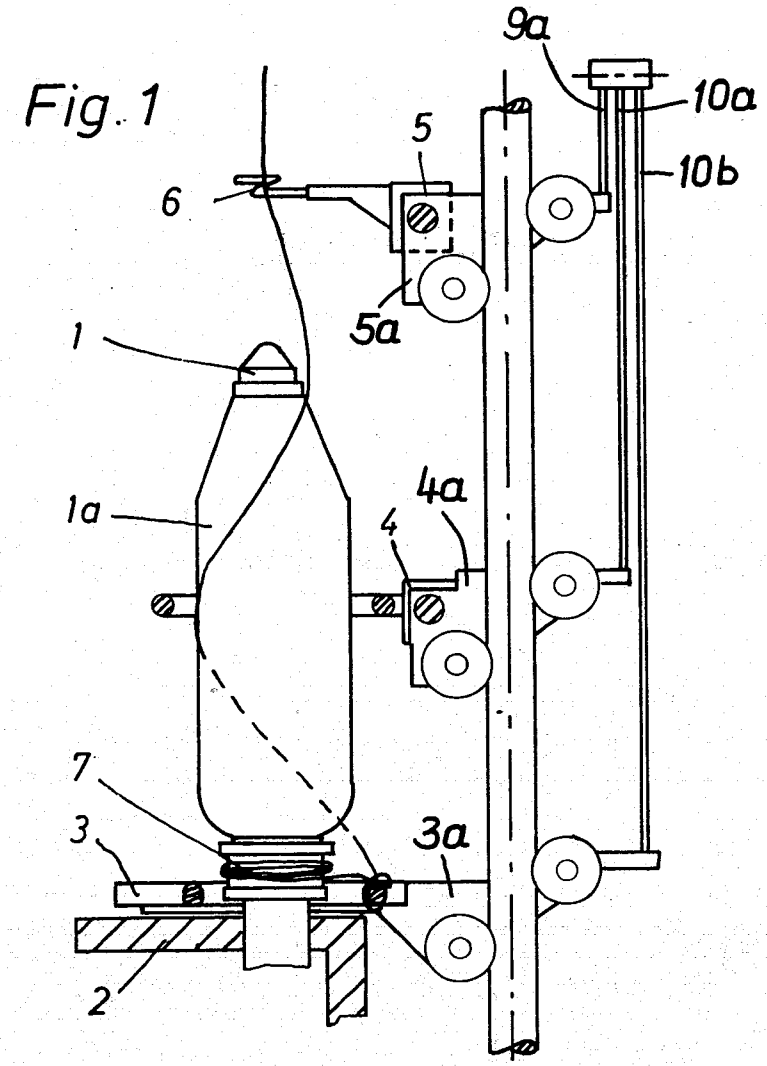
FIG. 1 is a side elevational view of a spindle at rest with a full cop before the yarn is released, in accordance with the present invention, the ring rail being in the underwinding position, the balloon control rail not having yet been lowered, and the yarn being approximately in the position shown in the drawing.
Figure 3:
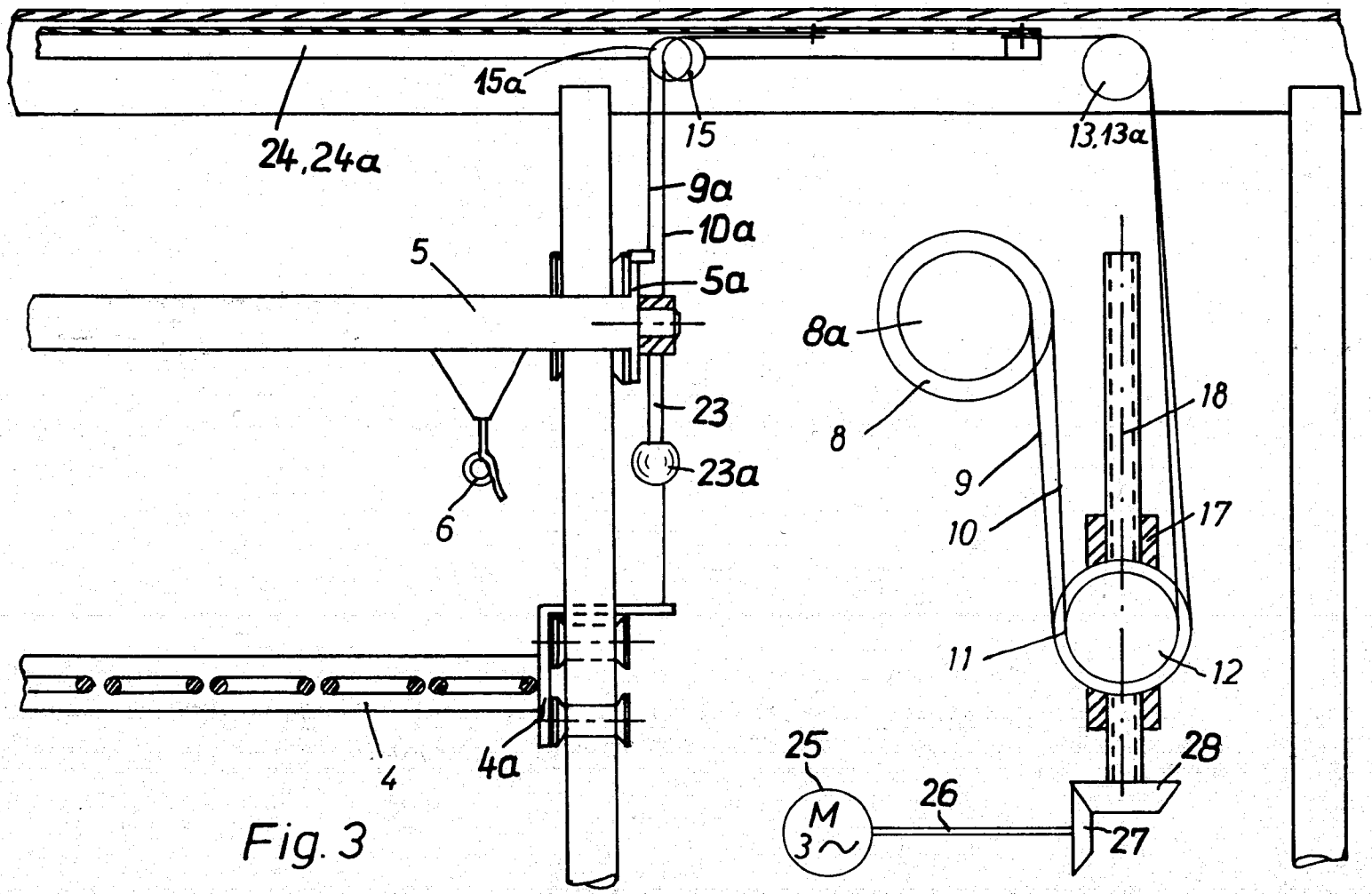
FIG. 3 is a front elevational view of the arrangement of FIGS. 1 and 2 without a cop, showing the yarn guide rail with a yarn guide in the pivoted-out position and the balloon control rail, including a plurality of balloon control rings, as well as a winding mechanism according to the invention for the simultaneous automatic moving of the yarn guides and the balloon control rail, a handle being provided for longitudinally rotating the yarn guide rail.

FIGS. 1–3 illustrate an embodiment of the invention in a spinning position having the following known configuration:

A spindle 1 having a cop 1*a* thereon is held in a spindle rail 2. A ring rail 3 moves vertically along spindle 1 in a manner dictated by the desired cop configuration, or winding pattern, as the spindle is rotated about its axis. A balloon control rail 4 is also guided along the spindle axis. Furthermore, a yarn guide rail 5 with its yarn guide wires 6 moves in accordance with the desired cop configuration so that the most favorable yarn tension conditions result.

In a manner which is similarly known, the ring rail 3 takes on the underwinding position shown in the drawing. In this position, the yarn is, upon completion of the winding of each cop, wound a number of turns around an underwinding spool 7. Upon removal of the full cop from the spindle, the yarn in the cop breaks off at the underwinding spool. However, yarn remains connected to the spindle through the turns on the underwinding spool so that it is not necessary to connect the yarn again from the supply in order to wind the next cop. The cop is removed from the spindle by being gripped at least from the front and sides either manually or by means of the grippers of an automatic cop changing device. Before such removal, the yarn coming through yarn guide wire 6 must be released so that it will not also be gripped. Moreover, the balloon control rail 4 is moved into its lowermost position, shown in FIG. 2, before the cop is removed.

FIGS. 1 and 2 illustrate the manner in which the yarn is simultaneously released, from its position according to FIG. 1 to take on the position according to FIG. 2, at the full cops of a group of spinning positions.

According to the present invention, the yarn guide rail 5 which is simultaneously used as the yarn release rail, is at the start of this position change, rotated by 90° about its longitudinal axis so that the yarn guides 6 are pivoted downwardly. Then the yarn guide rail 5 is lowered toward the foot of the spindle or toward the underwinding spool 7, respectively, until the yarn guides 6 come to lie relatively closely above the balloon control rail 4, which is now in its lowermost position. Then the yarn has been released sufficiently from cop 1*a* that the cop can be gripped from the sides and removed from the spindle without breaking the yarn coming in to the ring rail 3.

The yarn guide rail 5, the balloon control rail 4 and the ring rail 3 (see FIGS. 1,2) are mounted to be vertically movable in a well known manner by means of rollers engaging at least one vertical rod in a gripping manner and suitable motion transmitting elements, such as wires or cables 9*a*, 10*a* and 10*b* respectively.

For the sake of clarity, FIG. 3 shows an embodiment the cable 10*b* and the ring rail 3 being omitted. The rails 4 and 5, associated to the cables 9*a* and 10*a* respectively with respective guide rollers 15 and 15*a*, are connected to adjacent coupling rails 24 and 24*a* respectively. These coupling rails carry - regarded in the length of the spinning machine - by means of further cables corresponding to the cables 9*a* and 10*a* the other sections of the rails 4 and 5 (not shown for the sake of simplification).

The coupling rails 24 and 24*a* in their turn are operated by ropes 9 and 10, respectively, which are connected to the end sections of the coupling rails and are guided by guide rollers 13, 13*a* and 11, 12, the ropes 9 and 10 being driven by preferably coaxially arranged layered raising discs 8 and 8*a*, respectively, and forming loops around the preferably coaxially arranged guide rollers 11 and 12, respectively. The raising discs 8 and 8*a*, operated in a well known manner by a change-over gear, effect the normal building of the spindle cops.

According to the invention, for releasing the yarn during the cop change the yarn guide rail 5, to which is fastened a hand pivot lever 23 with handle 23*a*, is turned to a vertical position. Subsequently, the rails 5 and 4 are lowered simultaneously by raising a spindle nut 17 connected to them, which can be operated (i.e. raised or lowered) by rotating a matingly threaded spindle shaft 18. The spindle shaft 18 can be rotated manually or, as shown in FIG. 3, by means of a motor 25 which drives the spindle shaft via a shaft 26 and bevel gears 27, 28.

The simultaneous lowering of the rails 4 and 5 is continued, until the guide carriage 4*a* of rail 4 lies upon the guide carriage 3*a* of rail 3 (see FIG. 2). By continuing the upward movement of the guide rollers 11 and 12 relative to the spindle shaft 18, rope 10 of rail 4 becomes loose, whereby the loop of rope 10 hangs beneath the guide roller 12. After further upward movement of the guide rollers 11 and 12, the rail 5 operated by the guide carriage 5*a* has reached a position where the yarn guide 6, rotated according to the invention by 90° about its longitudinal axis, lies (as shown in FIG. 2) adjacent to the balloon control rail 4.

The raising discs 8 and 8*a* perform alternating rotations which are dimensioned with regard to speed and amount as described by Johannsen/Walz in "Handbuch der Baumwollspinnerei", Vol. 5, pages 26 and following (published in 1956 by "Verlag Handwerk und Technik", Berlin-Hamburg).

Figure 4:
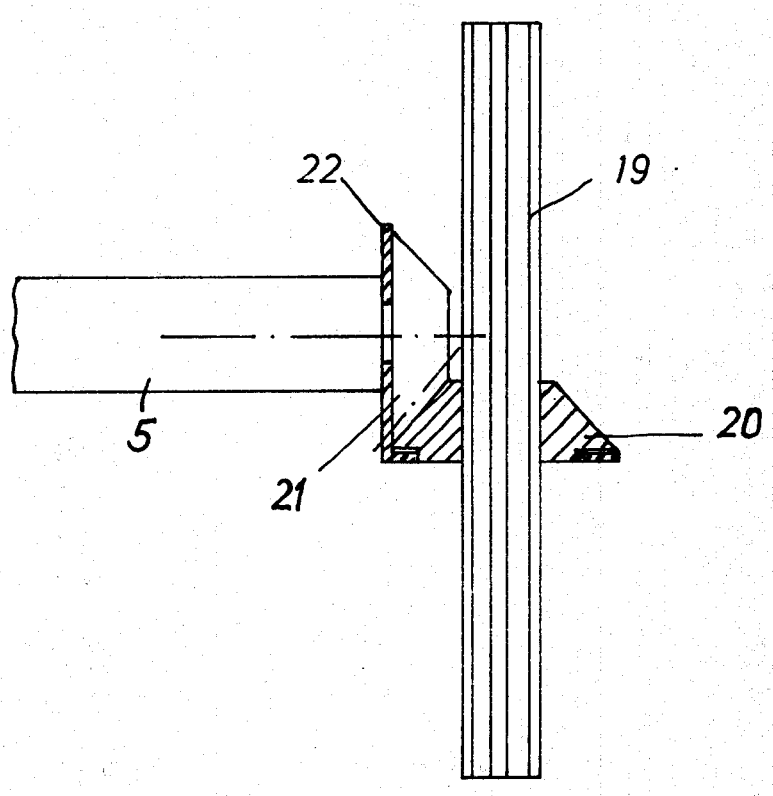
FIG. 4 is a cross-sectional front view, to a scale larger than that of FIGS. 1 to 3, of an embodiment of the present invention for an apparatus for automatically longitudinally rotating the yarn guide rail for the purpose of pivoting the yarn guides.

FIG. 4 illustrates an advantageous feature of the present invention according to which the longitudinal rotation, or pivoting, of the yarn guide rail 5 and maintenance thereof in the spinning position or in the position where the yarn guides 6 are pivoted out can be effected by operation of a splined shaft 19 and bevel gears 20 and 21, the bevel gears being mounted in a bearing block 22. The splined shaft 19 may be actuated in any known manner, either manually, mechanically or electromechanically.

With respect to the embodiment of FIG. 4, the following details are not shown in the drawing.

The splined shaft 19 is mounted in the machine frame to be longitudinally immovable and can be driven by a motor. The bearing block 22 can be moved up and down together with the bevel gears 20 and 21 and with the yarn guide rail 5, the bearing block 22 being guided by part 5 itself or, if required, additionally along the machine frame. During such movements, the bevel gear 20 slides along splined shaft 19.

In apparatus having the structure shown in FIGS. 3 and 4, rotation of the yarn guide rail 5 about its longitudinal axis and lowering of the yarn guide rail toward the foot of the spindle can each be effected by motor drives. This makes it possible to practice the method of the present invention, for the simultaneous release of the yarn at a group of cops, in a completely automatic manner.

A spinning machine in which the apparatus according to the invention can be employed is described by Johannsen/Walz in "Handbuch der Baumwolltechnik", Vol. 5, pages 32 and following such as pages 91 and following (published in 1956 by "Verlag Handwerk und Technik", Berlin-Hamburg).

It will be understood that the above description of the present invention is susceptible to various modifications, changes and adaptations, and the same are intended to be comprehended within the meaning and range of equivalents of the appended claims.

What is claimed is:

1. In a method for the simultaneous freeing of yarn at a group of cops during the changing of cops in a spinning machine having spindles without appendages, the machine including a yarn guide rail carrying yarn guides which grip the yarn from the side and means supporting the guide rail for downward movement from the region above the spindles toward the foot of the spindles, the improvement wherein the yarn guide rail is employed as the yarn freeing rail and comprising effecting downward movement of said yarn guide rail by initially rotating said rail through 90° about an axis extending in the longitudinal direction of said rail so that the yarn guides are pivoted downwardly, and subsequently lowering the yarn guide rail toward the foot of the spindles.

2. A method as defined in claim 1 wherein each spindle is provided with an underwinding spool below the region in which a cop is formed, and said step of lowering the yarn guide rail is carried out to lower such rail toward the underwinding spools.

3. Apparatus for the simultaneous freeing of yarn at a group of cops during the changing of cops in a spinning machine having spindles without appendages, comprising: a yarn guide rail carrying yarn guides arranged to grip such yarn from the side; means supporting said yarn guide rail for downward movement from the region above the spindles toward the foot of the spindles, such movement including initially rotating said rail through 90° about an axis extending in the longitudinal direction of said rail, so that said yarn guides are pivoted downwardly, and subsequently lowering said yarn guide rail toward the foot of the spindles, whereby said yarn guide rail acts as a yarn freeing rail; a balloon control rail operatively associated with the spindles; means supporting said balloon control rail at a location below said yarn guide rail for vertical movement over a path extending downwardly to the foot of the spindles; and drive means connected to said means supporting said yarn guide rail and said means supporting said balloon control rail for initially moving said yarn guide rail and said balloon control rail downwardly together until said balloon control rail reaches the lower end of its path of movement, and for subsequently continuing the downward movement of said yarn guide rail until it reaches the vicinity of said balloon control rail.

4. Apparatus as defined in claim 3 wherein said drive means comprise two rope pulley systems each connected to a respective one of said yarn guide rail and said balloon control rail, each said rope pulley system including a rope arrangement having one end connected to its respective rail, a plurality of guide rollers and a coupling rail operatively connected to said rope arrangement; a raising disc connected to the other end of said rope arrangement; and a further guide roller around which passes a portion of said rope arrangement near said other end thereof, and said apparatus further comprising means supporting said further guide rollers of both said pulley systems for simultaneous vertical movement, whereby upward movement of said further guide rollers causes such downward movement of said rails.

5. Apparatus as defined in claim 4 wherein said raising discs of both said pulley systems are arranged coaxially to one another, and said further guide rollers of both said pulley systems are arranged coaxially to one another.

6. Apparatus as defined in claim 4 wherein said means supporting both said further guide rollers comprise an internally threaded spindle nut carrying both of said guide rollers, and a matingly threaded spindle shaft threadedly engaging said nut and rotatable for raising and lowering said nut.

7. An arrangement as defined in claim 3 further comprising means connected to said yarn guide rail for rotating said rail about the axis extending in the longitudinal direction of said rail, said means for rotating including: a splined shaft support for rotation; a bearing block supported by said yarn guide rail; and a pair of meshing bevel gears supported by said bearing block, one of said gears being mounted on said splinded shaft for rotation therewith and for sliding movement along the length thereof and the other of said gears being fixed to said yarn guide rail, whereby rotation of said shaft produces such rotational movement of said yarn guide rail.

* * * * *